US008480073B1

(12) United States Patent
Ishikawa et al.

(10) Patent No.: US 8,480,073 B1
(45) Date of Patent: Jul. 9, 2013

(54) SHEET FEEDER AND IMAGE FORMING APPARATUS INCORPORATING SAME

(75) Inventors: Yoshikuni Ishikawa, Tokyo (JP); Shun Kobayashi, Kanagawa (JP); Manabu Nonaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/333,555

(22) Filed: Dec. 21, 2011

(30) Foreign Application Priority Data

Jan. 5, 2011 (JP) ..... 2011-000649

(51) Int. Cl.
*B65H 3/16* (2006.01)
*B65H 1/08* (2006.01)

(52) U.S. Cl.
USPC ..... 271/18.2; 271/147; 271/148; 271/126

(58) Field of Classification Search
USPC ..... 271/18.1, 18.2, 147, 148, 162, 126, 271/127
See application file for complete search history.

(56) References Cited

U.S. PATENT DOCUMENTS 5,634,188 A * 5/1997 Johnston et al. ..... 399/393
6,123,329 A * 9/2000 Sato et al. ..... 271/9.01
6,283,469 B1 * 9/2001 Weber ..... 271/148
6,629,693 B2 * 10/2003 Siow et al. ..... 271/171
8,157,257 B2 * 4/2012 Toyooka et al. ..... 271/18.1
8,177,223 B2 * 5/2012 Bauer et al. ..... 271/157
2007/0013121 A1 * 1/2007 Kang et al. ..... 271/9.01
2011/0101603 A1 * 5/2011 Bauer et al. ..... 271/265.01

FOREIGN PATENT DOCUMENTS

JP 04-173633 A 6/1992
JP 05-139548 A 6/1993
JP 09-309624 A 12/1997

* cited by examiner

*Primary Examiner* — Kaitlin Joerger
(74) *Attorney, Agent, or Firm* — Harness, Dickey & Pierce, P.L.C.

(57) ABSTRACT

A sheet feeder includes: an attracting and separating device disposed above a leading end portion in a sheet-feeding direction of a sheet stack, attracting and holding an uppermost sheet of the sheet stack with electrostatic force and separating the uppermost sheet from the sheet stack, a sheet loading device carrying the sheet stack, and including a first bottom plate carrying a rear-side portion of the sheet stack and a second bottom plate separated from the first bottom plate and carrying the leading end portion of the sheet stack below the attracting and separating device; and a lifting device lifting and lowering the sheet loading device, and including a first lifting device lifting and lowering the first bottom plate and a second lifting device lifting and lowering the second bottom plate to move the leading end portion of the sheet stack toward and away from the attracting and separating device.

13 Claims, 6 Drawing Sheets

SHEET FEEDER AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2011-000649, filed on Jan. 5, 2011, in the Japanese Patent Office, the entire disclosure of which is hereby incorporated by reference herein.

FIELD OF THE INVENTION

The present invention relates to a sheet feeder and an image forming apparatus, and more particularly to a sheet feeder that feeds a sheet on the uppermost surface of a stacked sheet stack by separating the sheet from the other sheets of the sheet stack, and an image forming apparatus, such as an electrophotographic copier, facsimile machine, or printer, for example, including the sheet feeder.

BACKGROUND OF THE INVENTION

There is known a background sheet feeder that employs a so-called electrostatic attraction and separation method of separating a sheet from other sheets by attracting the sheet using static electricity.

The background sheet feeder includes an endless belt and a charging member. The endless belt is formed by a dielectric member provided to face the upper surface of a stacked sheet stack and moving in the sheet feeding direction. The charging member applies an alternating voltage to a surface of the endless belt to charge the surface of the belt and generate an electric field, which in turn generates an attraction force that separates the uppermost sheet from the stacked sheet stack.

In the sheet feeder, the endless belt is wound around a pair of eccentric rollers, each of which rotates about an eccentric shaft connected to a drive device such as a motor. The eccentric rollers are rotated by the drive device, thereby moving the endless belt reciprocally toward and away from the upper surface of the sheet stack. Each of the eccentric rollers is held at a home position at which a circumferential portion thereof most distant from the eccentric shaft is located at the top. At the home position, therefore, the endless belt is separated from the upper surface of the sheet stack.

In the thus-configured sheet feeder, the endless belt rotates when the eccentric rollers rotate upon start of a sheet feeding operation. As the endless belt moves, the surface of the endless belt is charged. At the same time, the endless belt moves downward from the home position in accordance with the rotation of the eccentric rollers, and approaches the upper surface of the sheet stack. Then, each of the eccentric rollers rotates to a position at which the circumferential portion thereof most distant from the eccentric shaft is located at the bottom and the uppermost sheet is electrostatically attracted to the endless belt owing to the attraction force generated by the electrical charge. Thereafter, the eccentric rollers further rotate to separate the leading end in the sheet feeding direction of the uppermost sheet from the endless belt owing to the curvature of one of the eccentric rollers. As the rollers continue to rotate, the uppermost sheet enters the space between conveyance guides and is then sent downstream in the sheet feeding direction on a conveyance path.

As well as the above-described method, the method of moving the endless belt and the sheet stack alternately toward and away from each other includes, for example, a method of vertically moving a belt unit, which holds the endless belt, via a wire using a drive device such as a solenoid or a motor, and a method of vertically rotating one of the paired rollers, around which the endless belt is wound, about the other roller as a hinge using the drive force of a motor.

It is to be noted that the sheet feeder is not limited to the configuration of moving the endless belt toward and away from the sheet stack. Alternatively, for example, the sheet feeder can be configured to move the sheet stack toward and away from the endless belt by vertically moving a bottom plate loaded with the sheet stack via a linkage mechanism or a rack and pinion mechanism using the drive force of a motor or the like.

In the sheet feeder that moves the endless belt toward and away from the sheet stack by vertically moving the belt unit via a wire using a drive device such as a solenoid or a motor, however, if the drive device is rapidly driven to improve productivity, i.e., to increase the number of sheets fed per unit time, the wire may sag in response to inertia at the time of rapid drive. The slack in the wire hinders reducing the time taken for the repeating operation of moving the endless belt toward and away from the sheet stack, thereby limiting any improvement in productivity. It is therefore desirable to perform a drive operation that does not cause the wire to go slack in response to inertia.

Further, in the sheet feeder that vertically rotates one of the paired rollers, around which the endless belt is wound, about the other roller as a hinge using the drive force of a motor, the motor generates relatively high rotational torque to rotate the endless belt. Further, the motor is driven in the forward and reverse directions to vertically rotate the one of the rollers, and forward drive and reverse drive of the motor are performed in every sheet feeding operation. This type of sheet feeder, therefore, increases the load on the motor, and thus hinders improvements in productivity. The same problem occurs in the sheet feeder configured to move the sheet stack toward and away from the endless belt by vertically moving the bottom plate loaded with the sheet stack, the motor generates sufficient drive force for vertically moving the entire weight of the sheet stack loaded on the bottom plate. That is, the motor for vertically moving the bottom plate generates relatively high rotational torque sufficient for vertically moving the entire weight of the sheet stack, and as in therefore this type of sheet feeder also increases the load on the motor, hindering productivity gains.

SUMMARY OF THE INVENTION

The present invention describes a novel sheet feeder. In one example, a novel sheet feeder includes an attracting and separating device, a sheet loading device, and a lifting device. The attracting and separating device is disposed above a leading end portion of a sheet stack, and is configured to attract and hold from the sheet stack an uppermost sheet on the uppermost position of the sheet stack using electrostatic force and separate the uppermost sheet from the sheet stack. The sheet loading device is disposed below the attracting and separating device and is configured to carry the sheet stack loaded thereon, and includes a first bottom plate configured to carry a trailing end portion of the sheet stack loaded thereon and a second bottom plate contiguous to and provided separately from the first bottom plate and configured to carry the leading end of the sheet stack loaded thereon below the attracting and separating device. The lifting device is configured to lift and lower the sheet loading device, and includes a first lifting device configured to lift and lower the first bottom plate and a second lifting device configured to lift and lower the second bottom plate to move the leading end portion of the sheet stack toward and away from the attracting and separating device.

The above-described sheet feeder may further include an angle detector provided adjacent to a lateral portion of the attracting and separating device. The attracting and separating device may include a downstream roller provided on the downstream side in the sheet feeding direction, an upstream roller provided upstream of the downstream roller in the sheet feeding direction and rotatable about the downstream roller as a hinge, and an endless dielectric belt rotatably stretched around the upstream roller and the downstream roller. The detector may detect the arrival of the dielectric belt to a position parallel to the sheet stack.

The detector may be one of a photointerrupter and a feeler sensor.

The second lifting device may lift and lower the second bottom plate parallel to the first bottom plate.

The first bottom plate and the second bottom plate may be joined by a hinge, and the second bottom plate may be rotatable about the hinge relative to the first bottom plate. The second lifting device may rotate the second bottom plate about the hinge to lift and lower the second bottom plate.

The second bottom plate and the second lifting device may be disposed on an upper surface of the first bottom plate at a position corresponding to the leading end portion of the sheet stack.

The above-described sheet feeder may further include a drive device provided to the first bottom plate to drive the second lifting device.

The present invention further describes a novel image forming apparatus. In one example, a novel image forming apparatus includes the above-described sheet feeder and an image forming device configured to form an image on an uppermost sheet separated and fed from a sheet stack by the sheet feeder.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
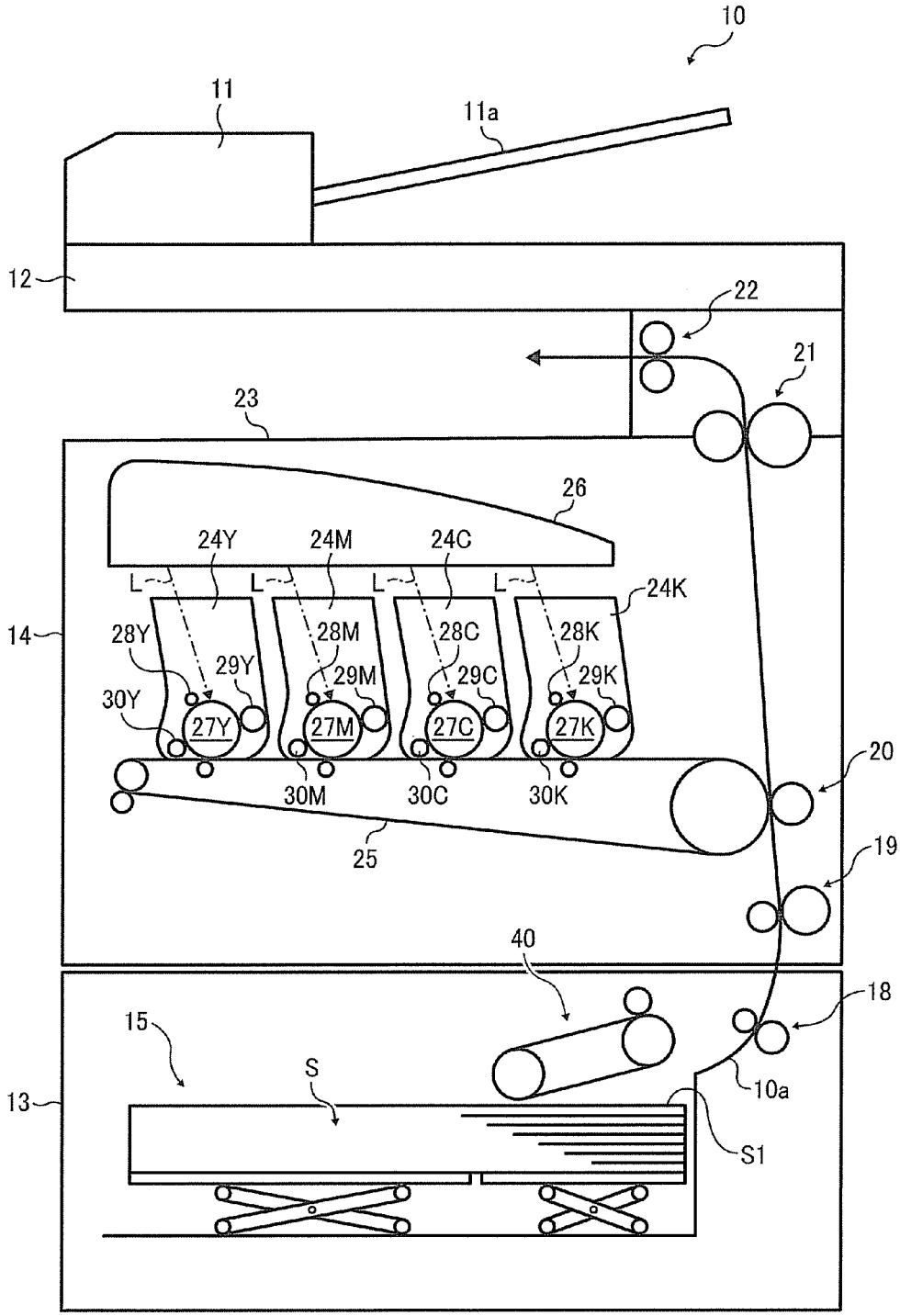
FIG. 1 is a schematic configuration diagram of an image forming apparatus including a sheet feeder according to a first embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, embodiments of the present invention will be described below.

A first embodiment of the present invention will now be described. FIGS. 1 to 3C are diagrams illustrating a sheet feeder according to an embodiment of the present invention and an image forming apparatus according to an embodiment of the present invention. The drawings illustrate an example in which the image forming apparatus is applied to an electrophotographic copier.

The configuration of the image forming apparatus will be first described. As illustrated in FIG. 1, a copier 10 serving as the image forming apparatus includes an automatic document conveying device 11, a document reading unit 12, a sheet feeding unit 13, and an image forming unit 14. The automatic document conveying device 11 separates a document from the other documents of a document bundle loaded on a document tray 11*a*, and automatically feeds the document to a contact glass on the document reading unit 12. The document reading unit 12 reads the document conveyed onto the contact glass by the automatic document conveying device 11. The sheet feeding unit 13 stores a sheet stack S including a plurality of stacked sheets, and feeds from the sheet stack S an uppermost sheet S1 on the uppermost position of the sheet stack S to the image forming unit 14. The image forming unit 14 serving as an image forming device forms, on the sheet, i.e., recording medium fed from the sheet feeding unit 13, an image read by the document reading unit 12. In the present embodiment, the image forming unit 14 and the sheet feeding unit 13 are separable from each other.

The sheet feeding unit 13 includes a sheet feeder 15 that feeds the uppermost sheet S1 by attracting and separating the uppermost sheet S1 from the sheet stack S loaded on a later-described sheet loading unit 50 illustrated in FIG. 2.

The uppermost sheet S1 separated and fed by the sheet feeder 15 is conveyed on a conveyance path 10*a* by a conveying roller pair 18 and a registration roller pair 19. Further, a toner image formed by the image forming unit 14 is transferred by a transfer roller 20 onto the uppermost sheet S1 conveyed by the conveying roller pair 18 and the registration roller pair 19, and is heat-fixed on the uppermost sheet S1 by a fixing device 21. Then, the uppermost sheet S1 is discharged to a sheet discharge tray 23 by a sheet discharging roller pair 22.

The image forming unit 14 includes four image forming units 24, i.e., image forming units 24Y, 24M, 24C, and 24K for yellow, magenta, cyan, and black colors, respectively, an intermediate transfer belt 25 serving as a transfer belt, and an exposure device 26.

The exposure device 26 converts color-separated image data input from, for example, a personal computer or a word processor or image data of the document read by the document reading unit 12 into signals for driving light sources, and drives semiconductor laser devices of respective laser light source units in accordance with the signals to emit light beams.

The image forming units 24Y, 24M, 24C, and 24K form toner images of different colors. Each of the image forming units 24Y, 24M, 24C, and 24K includes a photoconductor 27, (i.e., photoconductors 27Y, 27M, 27C, and 27K, respectively) serving as an image carrying member driven to rotate in the clockwise direction in the drawing, and also includes, for example, a charging unit 28 (i.e., charging units 28Y, 28M, 28C, and 28K illustrated in FIG. 1), a development unit 29 (i.e., development units 29Y, 29M, 29C, and 29K illustrated in FIG. 1), and a cleaning unit 30 (i.e., cleaning units 30Y, 30M, 30C, and 30K illustrated in FIG. 1) arranged around the photoconductor 27.

Each of the photoconductors 27 is formed into a substantially cylindrical shape, and is driven to rotate by a not-illustrated drive source. The outer circumferential surface of the photoconductor 27 is provided with a photosensitive layer. The respective outer circumferential surfaces of the photoconductors 27 are subjected to spot irradiation of the light beams emitted from the exposure device 26 and indicated by broken lines in the drawing. Thereby, electrostatic latent images according to the image information are written on the outer circumferential surfaces of the photoconductors 27.

The charging unit 28 uniformly charges the outer circumferential surface of the photoconductor 27. The present embodiment employs, as the charging unit 28, a contact type charging unit which comes into contact with the photoconductor 27. The development unit 29 supplies toner to the photoconductor 27. The supplied toner adheres to the electrostatic latent image written on the outer circumferential surface of the photoconductor 27. Thereby, the electrostatic latent image on the photoconductor 27 is visualized as a toner image. The present embodiment employs, as the development unit 29, a non-contact type development unit which does not come into contact with the photoconductor 27.

The cleaning unit 30 cleans residual toner adhering to the outer circumferential surface of the photoconductor 27. The present embodiment employs, as the cleaning unit 30, a brush contact type cleaning unit which brings a brush into contact with the outer circumferential surface of the photoconductor 27.

The intermediate transfer belt 25 is an endless belt, i.e., a circular belt including a resin film or a rubber as a base material thereof. The toner images formed on the photoconductors 27 are transferred onto the intermediate transfer belt 25, and then are transferred onto the uppermost sheet S1 by the transfer roller 20.

The copier 10 may employ, as well as the electrophotographic method, another method, such as the inkjet method, for example. Further, the image forming apparatus is not limited to the copier 10, and may be configured as a printer, a facsimile machine, a printing machine, or a multifunction machine.

Figure 2:
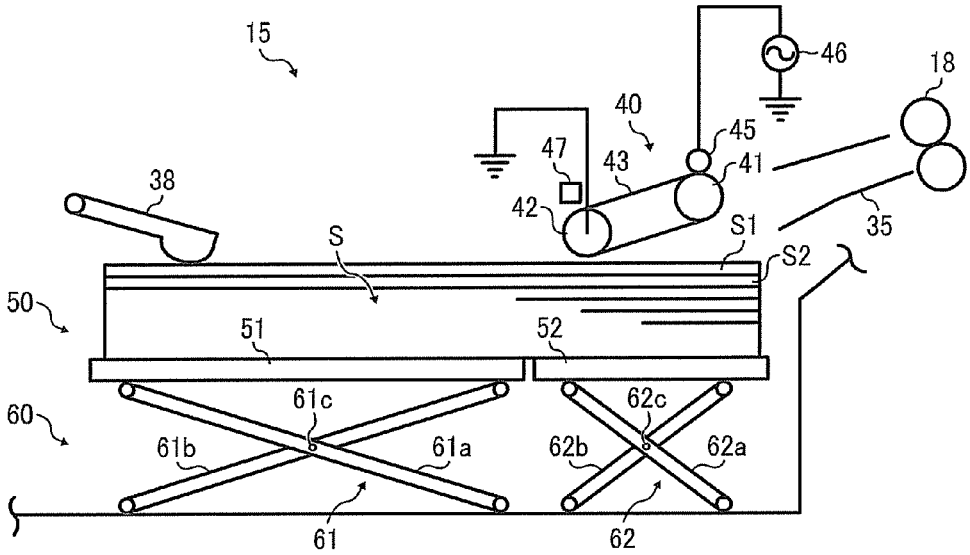
FIG. 2 is a cross-sectional view illustrating a schematic configuration of the sheet feeder according to the first embodiment of the present invention.

With reference to FIG. 2, the sheet feeder 15 according to the present embodiment will now be described. As illustrated in FIG. 2, the sheet feeder 15 includes an attracting and separating unit 40, a sheet loading unit 50, and a lifting mechanism unit 60. The attracting and separating unit 40 serves as an attracting and separating device. The sheet loading unit 50 serves as a sheet loading device which carries the sheet stack S loaded thereon. The lifting mechanism unit 60 serves as a lifting device which lifts and lowers the sheet loading unit 50.

The attracting and separating unit 40 is disposed above a leading end portion of the sheet stack S in the sheet feeding direction, i.e., the left-to-right direction in FIG. 2. The attracting and separating unit 40 attracts and holds the uppermost sheet S1 from the sheet stack S using electrostatic force, and separates the uppermost sheet S1 from the sheet stack S. Further, the width of the attracting and separating unit 40 is less than the width of the uppermost sheet S1, and is disposed near the center of the uppermost sheet S1 in the width direction. The attracting and separating unit 40 may have a width equal to or greater than the width of the uppermost sheet S1. Further, the attracting and separating unit 40 may be provided in plurality in the width direction of the uppermost sheet S1.

Specifically, the attracting and separating unit 40 includes a drive roller 41, a driven roller 42, and a dielectric belt 43. The drive roller 41 serves as a downstream roller provided on the downstream side in the sheet feeding direction. The driven roller 42 serves as an upstream roller provided upstream of the drive roller 41 in the sheet feeding direction with a distance from the drive roller 41. The dielectric belt 43 is formed by an endless dielectric member stretched between the drive roller 41 and the driven roller 42.

The drive roller 41 includes a not-illustrated drive shaft rotatably supported by a housing unit of the copier 10 illustrated in FIG. 1, specifically a housing of the sheet feeding unit 13, and is intermittently driven to rotate in accordance with a sheet feeding signal via an electromagnetic clutch by a not-illustrated drive motor provided to the body of the copier 10. Thereby, the dielectric belt 43 is driven to rotate. Further, the outer circumferential surface of the drive roller 41 is provided with a conductive rubber layer having a resistance value of approximately $10^6$ Ω·cm (ohm centimeters).

The driven roller 42 is a metal roller, the surface and the interior of which are both made of metal. The dielectric belt 43 is driven to rotate in accordance with the drive of the drive roller 41, and thereby the driven roller 42 is driven. Herein, the driven roller 42 is rotatably attached to not-illustrated support members that regulate the interval between the driven roller 42 and the drive roller 41. Further, the driven roller 42 is biased in a direction separating from the drive roller 41 by not-illustrated biasing members, such as springs, provided to the support members. Thereby, the belt tension of the dielectric belt 43 is favorably maintained. With the belt tension and friction between the driven roller 42 and the inner circumferential surface of the dielectric belt 43, therefore, the driven roller 42 is driven in accordance with the drive of the drive roller 41. Normally, the sheet feeding or conveying operation is performed with conveying force of approximately 5 N (newtons) or less. That is, the operation does not require relatively high conveying force. Under a special condition, such as the case of a sheet having relatively high adhesive force, however, a slip may occur between the dielectric belt 43 and the drive roller 41 and the driven roller 42. In that case, the coefficient of friction between the inner circumferential surface of the dielectric belt 43 and respective contact surfaces of the drive roller 41 and the driven roller 42 may be increased to prevent the slip. The drive roller 41 and the driven roller 42 are both grounded.

The dielectric belt 43 has a two-layer structure including an outer layer and an inner layer. The outer layer is formed by a film made of, for example, polyethylene terephthalate having a resistance of approximately $10^8$ Ω·cm or more and a thickness of approximately 50 μm. The inner layer is formed by a conductive layer having a resistance of approximately $10^6$ Ω·cm or less and formed on the rear surface of the outer layer by aluminum vapor deposition. Thereby, the dielectric belt 43 is favorably charged.

The inner surfaces of opposite end edges of the dielectric belt 43 in the width direction are provided with not-illustrated ribs for preventing meandering of the dielectric belt 43. The ribs engage with opposite end surfaces of the drive roller 41 and the driven roller 42 to prevent the dielectric belt 43 from meandering.

Further, a charging roller 45 serving as a charging member and extending in the width direction of the dielectric belt 43 is in contact with the dielectric belt 43. The charging roller 45 is disposed to be in contact with the dielectric belt 43 near the position at which the dielectric belt 43 is wound around the drive roller 41. Further, the charging roller 45 is connected to an alternating current (hereinafter referred to as AC) power supply 46 which generates an AC voltage, and is applied with an alternating voltage as needed from the AC power supply 46. The charging roller 45 uses the inner layer of the dielectric belt 43 as a grounded opposite electrode. To supply charge to the dielectric belt 43, therefore, the charging roller 45 may be provided at any position on the dielectric belt 43, as long as the charging roller 45 is in contact with the outer layer of the dielectric belt 43. The present embodiment uses the charging roller 45 as a device for supplying charge to the dielectric belt 43. The device for supplying charge to the dielectric belt 43, however, is not limited thereto, and may include a charging blade, for example.

Further, as well as the AC voltage, the AC power supply 46 may provide a direct current (hereinafter referred to as DC) voltage alternated between high and low potentials. The waveform of the voltage may be, for example, a rectangular or sine wave. In the present embodiment, the outer circumferential surface of the dielectric belt 43 is applied with an AC voltage having an amplitude of approximately 4 kV (kilovolts).

Herein, when the dielectric belt 43 is applied with the alternating voltage from the AC power supply 46 via the above-described charging roller 45, charge patterns alternating with a pitch according to the frequency of the AC power supply 46 and the rotation speed of the dielectric belt 43 are formed on the outer layer of the dielectric belt 43. Preferably, the pitch is set to approximately 5 mm to approximately 15 mm, for example.

On the downstream side of the dielectric belt 43 in the sheet feeding direction, guide plates 35 for guiding the sheet conveyance and the conveying roller pair 18 are provided.

In the thus configured attracting and separating unit 40, the driven roller 42 is vertically rotatable about the drive shaft of the drive roller 41 as a hinge. In a standby state in which the attracting and separating operation is not performed, therefore, the driven roller 42 is located lower than the drive roller 41 under its own weight. Specifically, the driven roller 42 is lowered to a position at which the lower surface of the dielectric belt 43, i.e., the contact surface of the dielectric belt 43 which comes into contact with the sheet stack S is tilted at an angle of approximately 10 degrees to approximately 30 degrees with respect to the sheet stack S. Herein, as an example of a method of regulating the downward movement of the driven roller 42, stoppers provided to the above-described support members may come into contact with a bracket provided to the body of the copier 10, to thereby regulate the downward movement of the driven roller 42. In the standby state, therefore, the dielectric belt 43 is kept tilted at the above-described angle, and a predetermined interval of approximately 2 mm, for example, is formed between the outer circumferential surface of the dielectric belt 43 located under the driven roller 42 and the upper surface of the uppermost sheet S1. With the predetermined interval thus formed between the outer circumferential surface of the dielectric belt 43 and the upper surface of the uppermost sheet S1, a second sheet S2 and the subsequent sheets are prevented from being conveyed together with the uppermost sheet S1 in a superimposed manner in the subsequent sheet conveying operation.

In the vicinity of a lateral portion of the driven roller 42, a roller position detecting sensor 47 is provided. The roller position detecting sensor 47 includes, for example, a photo-interrupter or a feeler sensor, and detects the lifted driven roller 42. Accordingly, the roller position detecting sensor 47 is capable of detecting the arrival of the dielectric belt 43 to a position parallel, i.e., horizontal to the sheet stack S. The roller position detecting sensor 47 outputs to a not-illustrated main control unit a signal according to the result of detection. In accordance with the result of detection by the roller position detecting sensor 47, therefore, the main control unit stops driving a later-described second lifting unit 62 upon arrival of the dielectric belt 43 to the horizontal position. The roller position detecting sensor 47 of the present embodiment forms an angle detector according to an embodiment of the present invention.

On the upstream side of the sheet feeder 15 in the sheet feeding direction, a feeler sensor 38 is provided which detects a state in which the sheet stack S lifted by the lifting mechanism unit 60 is located at a sheet feedable position at which the uppermost sheet S1 is allowed to be fed. Herein, the sheet feedable position refers to the position at which the upper surface of the uppermost sheet S1 is in proximity to the lowermost portion of the tilted dielectric belt 43 with a predetermined interval of approximately 2 mm, for example, formed therebetween.

The sheet loading unit 50 includes a first bottom plate 51 and a second bottom plate 52. The first bottom plate 51 carries a trailing end portion of the sheet stack S loaded thereon. The second bottom plate 52 is provided separately from the first bottom plate 51, and carries the leading end of the sheet stack S loaded thereon below the attracting and separating unit 40. In the present embodiment, the width of the first bottom plate 51 in the sheet feeding direction is set to be greater than the width of the second bottom plate 52 in the sheet feeding direction. However, the width of the first bottom plate 51 in the sheet feeding direction and the width of the second bottom plate 52 in the sheet feeding direction may be set to the same value, or the width of the second bottom plate 52 in the sheet feeding direction may be set to be greater than the width of the first bottom plate 51 in the sheet feeding direction.

The lifting mechanism unit 60 includes a first lifting unit 61 and a second lifting unit 62. The first lifting unit 61 serves as a first lifting device which lifts and lowers the first bottom plate 51. The second lifting unit 62 serves as a second lifting device which lifts and lowers the second bottom plate 52. The first bottom plate 51, the second bottom plate 52, the first lifting unit 61, and the second lifting unit 62 are disposed in a not-illustrated sheet feeding cassette having a substantially flat box shape.

The first lifting unit 61 is formed by a linkage mechanism including two arms 61*a* and 61*b*, and rotates the two arms 61*a* and 61*b* about a hinge 61*c* to lift and lower the first bottom plate 51. The two arms 61*a* and 61*b* are rotated by a not-illustrated drive device, such as a motor, provided to the body of the copier 10. In the present embodiment, the first lifting unit 61 is configured to rotate the two arms 61*a* and 61*b* about the hinge 61*c*. The configuration, however, is not limited thereto. For example, the first lifting unit 61 may be configured to rotate each of the two arms 61*a* and 61*b* about a lower base end portion thereof as a hinge. Further, each of the arms

61*a* and 61*b* may be provided in plurality in the width direction of the sheet stack S, i.e., a direction perpendicular to the sheet feeding direction.

Similarly to the first lifting unit 61, the second lifting unit 62 is formed by a linkage mechanism including two arms 62*a* and 62*b*, and rotates the two arms 62*a* and 62*b* about a hinge 62*c* to lift and lower the second bottom plate 52. The two arms 62*a* and 62*b* are rotated by a not-illustrated drive device, such as a motor, provided to the body of the copier 10. Similarly to the first lifting unit 61, the second lifting unit 62 may be configured to rotate each of the two arms 62*a* and 62*b* about a lower base end portion thereof as a hinge. Further, each of the arms 62*a* and 62*b* may be provided in plurality in the width direction of the sheet stack S.

The respective drive devices for driving the first lifting unit 61 and the second lifting unit 62 are connected to the not-illustrated main control unit, and are driven in accordance with drive signals from the main control unit.

Herein, in the standby state in which the sheet attracting and separating operation is not performed and a sheet supply operation, for example, the first lifting unit 61 and the second lifting unit 62 adjust the respective rotational positions of the arms 61*a* and 61*b* and the respective rotational positions of the arms 62*a* and 62*b*, respectively, such that the first bottom plate 51 and the second bottom plate 52 are located at the same height. Further, after the setting of the sheet stack S, the first lifting unit 61 and the second lifting unit 62 respectively lift the first bottom plate 51 and the second bottom plate 52 maintained at the same height, while maintaining the substantially horizontal state of the first bottom plate 51 and the second bottom plate 52. That is, the respective drive devices are driven in synchronization with each other on the basis of the drive signals from the not-illustrated main control unit, and thereby the first lifting unit 61 and the second lifting unit 62 respectively lift the first bottom plate 51 and the second bottom plate 52 while keeping the first bottom plate 51 and the second bottom plate 52 synchronized with each other, i.e., substantially horizontal to each other. Thereafter, the first lifting unit 61 and the second lifting unit 62 stop lifting the first bottom plate 51 and the second bottom plate 52, respectively, when the upper surface of the uppermost sheet S1 on the sheet stack S turns on the feeler sensor 38, or after the upper surface of the uppermost sheet 51 is lifted for a predetermined time since the activation of the feeler sensor 38. In this state, the predetermined interval of approximately 2 mm, for example, is formed, as described above, between the upper surface of the uppermost sheet S1 and the outer circumferential surface of the dielectric belt 43 located under the driven roller 42.

In addition to the above-described lifting of the second bottom plate 52 in synchronization with the first bottom plate 51, the second lifting unit 62 further moves the second bottom plate 52 toward and away from the dielectric belt 43 at the sheet feedable position at which the feeler sensor 38 is turned on. Herein, as illustrated in FIG. 3B, moving the second bottom plate 52 toward the dielectric belt 43 refers to lifting the second bottom plate 52 such that the upper surface of the leading end of the sheet stack S loaded on the second bottom plate 52 comes into contact with the lower surface of the dielectric belt 43. Herein, the above-described upper surface of the leading end of the sheet stack S corresponds to a minimum required area necessary to achieve attraction required for the attracting and separating operation and a contact area to which the dielectric belt 43 applies sufficient attraction force for separating the uppermost sheet S1 from the sheet stack S. Meanwhile, as illustrated in FIG. 3C, moving the second bottom plate 52 away from the dielectric belt 43 refers to lowering the second bottom plate 52 such that the upper surface of the sheet stack S is separated from the dielectric belt 43 having the uppermost sheet S1 attracted thereto. In the operation of lifting and lowering the second bottom plate 52 at the sheet feedable position, the second lifting unit 62 lifts and lowers the second bottom plate 52 parallel to the first bottom plate 51.

Figure 3A:
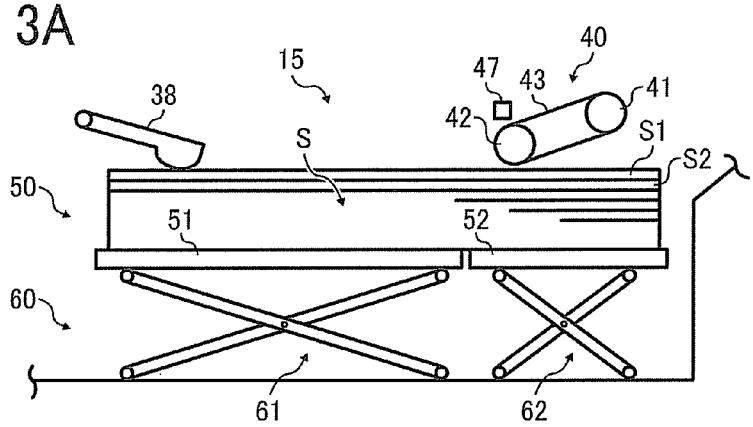
FIGS. 3A to 3C are diagrams illustrating an operation of the sheet feeder according to the first embodiment of the present invention.
Figure 3B:
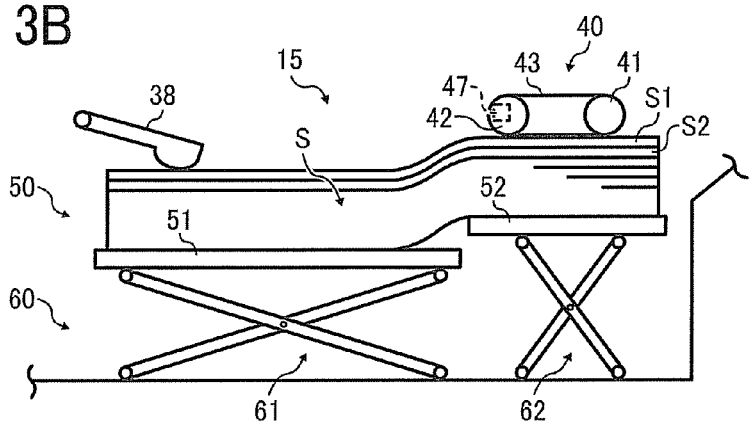
Figure 3C:
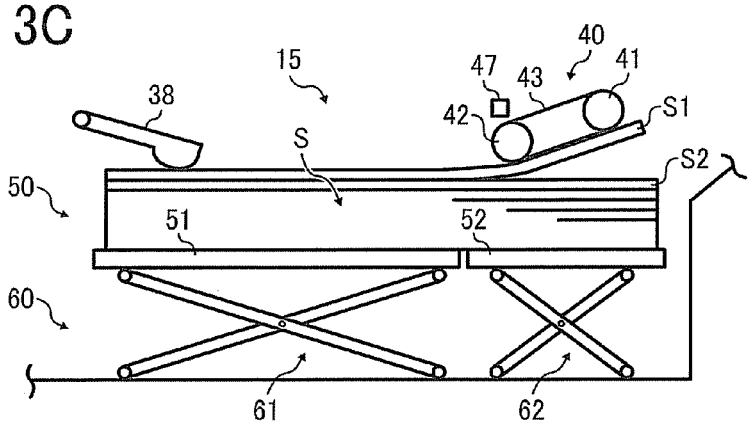

With reference to FIGS. 3A to 3C, the operation of the sheet feeder 15 will now be described. As illustrated in FIG. 3A, upon receipt of a sheet feeding command signal from the not-illustrated main control unit, the sheet separating and feeding unit 15 first drives the drive roller 41 to rotate, and thereby causing the dielectric belt 43 to rotate. Further, the dielectric belt 43 is applied with an alternating voltage via the charging roller 45 from the AC power supply 46. Thereby, charge patterns are formed on the outer circumferential surface of the dielectric belt 43. In this state, the first bottom plate 51 and the second bottom plate 52 are stopped at the sheet feedable position.

As illustrated in FIG. 3B, after the charging of the dielectric belt 43 is completed, the second lifting unit 62 lifts only the second bottom plate 52 while maintaining the horizontal state of the second bottom plate 52. Thereby, the leading end of the sheet stack S comes into contact with the outer circumferential surface of the dielectric belt 43 located under the driven roller 42, and the second bottom plate 52 is further lifted to push the dielectric belt 43 upward until the dielectric belt 43 reaches the horizontal position. Then, when the roller position detecting sensor 47 detects the arrival of the dielectric belt 43 to the horizontal position, the second lifting unit 62 stops lifting the second bottom plate 52. In this state, the lower surface of the dielectric belt 43 and the upper surface of the uppermost sheet S1 come into contact with each other. Then, the Maxwell stress acts on the uppermost sheet S1, which is a dielectric material, owing to a non-uniform electric field generated by the charge patterns formed on the outer layer of the dielectric belt 43. Thereby, the uppermost sheet S1 is attracted to the dielectric belt 43.

Then, after standing by at the position illustrated in FIG. 3B for a predetermined time taken for the attracting operation, the second lifting unit 62 lowers the second bottom plate 52 to the sheet feedable position, as illustrated in FIG. 3C. Thereby, a leading end of the uppermost sheet S1 is separated from the sheet stack S, and is attracted to and held by the dielectric belt 43. Specifically, after the attraction of the uppermost sheet S1, the driven roller 42 descends under its own weight in accordance with the descent of the second bottom plate 52. Thereby, the dielectric belt 43 is tilted, and the uppermost sheet S1 is separated from the sheet stack S by a so-called turning operation using the resilience of the sheet.

It should be noted that the sheet attraction force generated by the charge patterns generally acts on the second sheet S2 and the subsequent sheets for a certain time period after the moment of attraction of the uppermost sheet S1. After the lapse of the certain time period, however, the sheet attraction force acts only on the uppermost sheet S1, and no longer acts on the second sheet S2 and the subsequent sheets. In the present embodiment, the above-described turning operation reduces the certain time period. Accordingly, the productivity of the sheet feeding operation is improved. Further, the sheet feeding method of the present embodiment does not use frictional force acting between a sheet pickup device and a sheet. Therefore, the contact pressure between the dielectric belt 43 and the sheet stack S is reduced to a sufficiently small value, and a plurality of sheets are prevented from being fed together in a superimposed manner owing to friction.

As the dielectric belt 43 is driven to rotate, the uppermost sheet S1 attracted to and held by the dielectric belt 43 is then separated from the dielectric belt 43 at the drive roller 41 owing to the curvature thereof, conveyed in the sheet feeding direction, and sent to the conveyance path 10*a* illustrated in FIG. 1. The uppermost sheet S1 sent to the conveyance path 10*a* is conveyed to the image forming unit 14 by the conveying roller pair 18 and the registration roller pair 19, as illustrated in FIG. 1. The conveying roller pair 18 and the dielectric belt 43 are set to the same linear velocity. If the conveying roller pair 18 is intermittently driven to adjust the timing of conveyance, the dielectric belt 43 is also controlled to be intermittently driven. Further, the dielectric belt 43 is separated from the sheet stack S before the trailing end in the sheet feeding direction of the uppermost sheet S1 reaches a position facing the driven roller 42, to thereby prevent the second sheet S2 from being attracted to the dielectric belt 43.

In the case of a continuous sheet feeding operation of continuously feeding sheets, the operation illustrated in FIGS. 3A to 3C is repeatedly performed. In accordance with the reduction in load amount of the sheet stack S due to the continuous sheet feeding operation, the distance of upward and downward movement of the second bottom plate 52 is increased. Therefore, the first bottom plate 51 and the second bottom plate 52 are lifted in synchrony with each other, when the height of the sheet stack S corresponding to the load amount of the sheet stack S falls below a preset sheet stack height. The time of lifting the first bottom plate 51 and the second bottom plate 52 in synchrony with each other, which corresponds to the preset sheet stack height, is preferably set to the time at which the feeler sensor 38 is turned off, the time at which a predetermined number of sheets have been fed after the turn-off of the feeler sensor 38, or the time at which a predetermined time has elapsed after the turn-off of the feeler sensor 38.

If a discharging roller electrode is provided, the discharging roller electrode may apply an alternating voltage to the dielectric belt 43 to discharge the charged dielectric belt 43.

Specifically, when the outer circumferential surface of the dielectric belt 43 is brought into contact with the discharging roller electrode and is supplied with a DC voltage from a DC power supply, the dielectric belt 43 is not charged if the applied DC voltage does not reach a predetermined voltage. The predetermined voltage is referred to as the charge start voltage. The value V0 of the charge start voltage varies depending on, for example, the thickness and the volume resistivity of the dielectric belt 43.

It is known that, if the discharging roller electrode is supplied with an alternating voltage having the value V0 of the charge start voltage as the peak value thereof, the surface potential of the charged dielectric belt 43 is discharged to substantially 0 V. This indicates that the applied voltage having the peak value set to the value V0 of the charge start voltage is not capable of charging the charged object, i.e., the dielectric belt 43, which is a dielectric material, but is capable of discharging the charged object with force for moving space charge in the charging object. Further, the applied voltage used here alternates, and thus has a discharging effect whether the dielectric material is positively charged or negatively charged. If the applied voltage does not reach the charge start voltage, however, insufficient discharging is caused. Meanwhile, if the applied voltage exceeds the charge start voltage, charging is caused with an applied frequency of approximately 120 Hz (hertz) and a period (i.e., wavelength=velocity/frequency) of approximately 1 mm, and the charged object fails to be discharged to substantially 0 V. It is therefore desirable to control the peak value of the alternating voltage, which is to be applied to the discharging roller electrode, to be equal to the charge start voltage of the dielectric belt 43.

As described above, in the separation of the uppermost sheet S1 from the sheet stack S, the present embodiment is capable of causing the second lifting unit 62 to lift and lower only the leading end of the sheet stack S loaded on the second bottom plate 52. As compared with the background sheet feeder that lifts and lowers the entire sheet stack S, therefore, the present embodiment lifts and lowers only a portion of the sheet stack S required for the attracting and separating operation. Thus, the present embodiment reduces the load on the lifting mechanism unit 60 and the time taken for, for example, the attracting and separating operation. Even the configuration of moving the dielectric belt 43 and the sheet stack S toward and away from each other, therefore, obtains relatively high productivity.

Further, in the present embodiment, the dielectric belt 43 is rotated in accordance with the rotation of the driven roller 42 about the drive roller 41 as a hinge. Even if the sheet stack S is changed in position in accordance with the load amount thereof, therefore, the outer circumferential surface of the dielectric belt 43 is reliably brought into contact with the upper surface of the uppermost sheet S1. Further, the roller position detecting sensor 47 is capable of detecting the arrival of the dielectric belt 43 to the position parallel, i.e., horizontal to the sheet stack S. The present embodiment is therefore capable of stopping the lifting operation of the sheet stack S when the upper surface of the uppermost sheet S1 comes into contact with the outer circumferential surface of the dielectric belt 43.

Further, in the present embodiment, the second bottom plate 52 is lifted and lowered parallel to the first bottom plate 51. Even if the load amount of the sheet stack S is changed, therefore, the angle of contact between the dielectric belt 43 and the sheet stack S is unchanged. Accordingly, the minimum required area necessary to achieve attraction of the upper surface of the uppermost sheet S1, i.e., the upper surface of the leading end of the uppermost sheet S1, is relatively easily brought into contact with the dielectric belt 43.

Figure 4A:
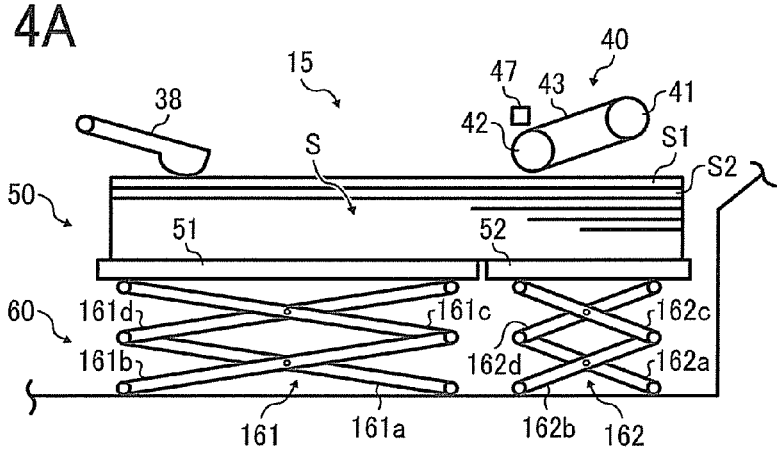
FIGS. 4A and 4B are cross-sectional views illustrating a modified example of the sheet feeder according to the first embodiment of the present invention.
Figure 4B:
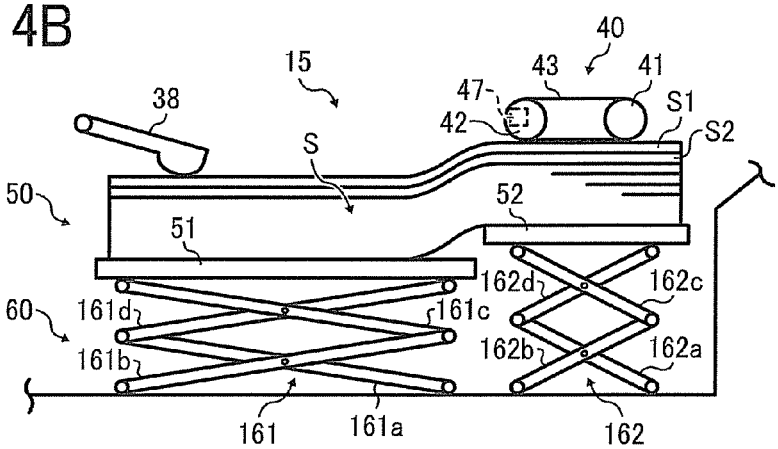

In the present embodiment, each of the first lifting unit 61 and the second lifting unit 62 is formed by a linkage mechanism including two arms. The configuration of the first lifting unit 61 and the second lifting unit 62, however, is not limited thereto. For example, each of the first lifting unit 61 and the second lifting unit 62 may be formed by a rack and pinion mechanism, or the first lifting unit 61 and the second lifting unit 62 may be replaced by a first lifting unit 161 and a second lifting unit 162, respectively, each including four arms, as illustrated in FIGS. 4A and 4B. Specifically, in the example of the second lifting unit 162, the second lifting unit 162 is configured such that each of lower arms 162*a* and 162*b* rotates about a lower base end portion thereof as a hinge, to thereby change the height of the linkage mechanism and lift the second bottom plate 52, for example, as illustrated in FIG. 4B. In this case, an upper base end portion of each of upper arms 162*c* and 162*d* is rotatably supported by the second bottom plate 52, but the position of the upper base end portion is fixed to prevent movement thereof in the sheet feeding direction.

In addition, although in the present embodiment the first lifting unit 161 is similar in configuration to the second lifting unit 162, alternatively, the first lifting unit 61 and the second lifting unit 62 may be configured differently, with one of the first lifting unit 61 and the second lifting unit 62 formed by a linkage mechanism including two arms and the other one of the first lifting unit 61 and the second lifting unit 62 formed by a linkage mechanism including four arms.

A sheet feeder according to a second embodiment of the present invention will now be described with reference to FIGS. 5 to 6C.

The sheet feeder according to the second embodiment is different from the sheet feeder according to the first embodiment of the present invention in the configuration of the second bottom plate and the second lifting unit, but is otherwise substantially similar to the sheet feeder according to the first embodiment. Therefore, the following description concentrates on only the differences between the first and second embodiments while using the same reference numerals as those used in the first embodiment illustrated in FIGS. 1 to 4B.

Figure 5:
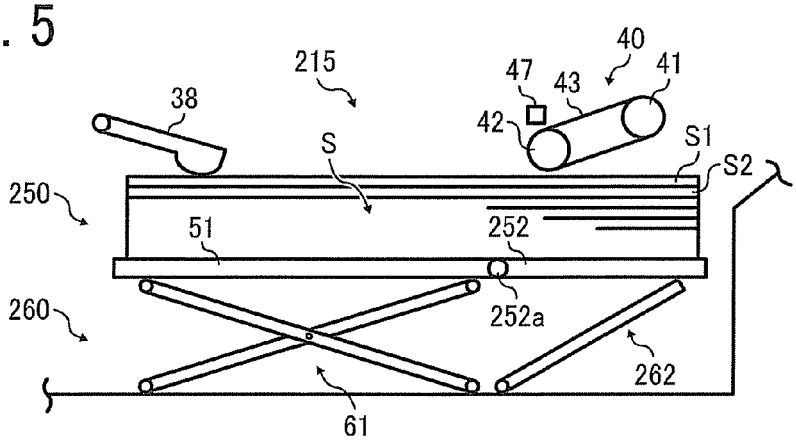
FIG. 5 is a cross-sectional view illustrating a schematic configuration of a sheet feeder according to a second embodiment of the present invention.

As illustrated in FIG. 5, a sheet feeder 215 according to the present embodiment includes an attracting and separating unit 40, a sheet loading unit 250, and a lifting mechanism unit 260. The attracting and separating unit 40 serving as an attracting and separating device is similar in configuration to the attracting and separating unit 40 of the first embodiment, and thus description thereof will be omitted. The sheet loading unit 250 serves as a sheet loading device which carries the sheet stack S loaded thereon. The lifting mechanism unit 260 serves as a lifting device which lifts and lowers the sheet loading unit 250.

The sheet loading unit 250 includes a first bottom plate 51, which is similar in configuration to the first bottom plate 51 of the first embodiment, and a second bottom plate 252 attached to the first bottom plate 51 to be vertically rotatable about a hinge 252*a*.

The lifting mechanism unit 260 includes a first lifting unit 61, which is similar in configuration to the first lifting unit 61 of the first embodiment, and a second lifting unit 262 serving as a second lifting device which lifts and lowers the second bottom plate 252.

The second lifting unit 262 includes a single arm rotatable about a lower base end portion thereof as a hinge, and is vertically rotated by a not-illustrated drive device, such as a motor, provided to the body of the copier 10. The shape of the second lifting unit 262 is not limited to the arm shape, and thus, for example, the second lifting unit 262 may be a flat plate. The second lifting unit 262 rotates to lift and lower the second bottom plate 252. Herein, as illustrated in FIG. 6B, lifting the second bottom plate 252 refers to tilting the second bottom plate 252 upward at a predetermined angle with respect to the first bottom plate 51. Further, lowering the second bottom plate 252 refers to moving the second bottom plate 252 from the state illustrated in FIG. 6B to the state in which the second bottom plate 252 is parallel to the first bottom plate 51, as illustrated in FIG. 6C.

Herein, as in the first embodiment, in the standby state in which the sheet attracting and separating operation is not performed and the sheet supply operation, for example, the first lifting unit 61 and the second lifting unit 262, respectively, lift the first bottom plate 51 and the second bottom plate 252 in synchrony with each other, and stop the lifting operation upon activation of the feeler sensor 38.

At the sheet feedable position at which the feeler sensor 38 is turned on, the second lifting unit 262 further moves the second bottom plate 252 toward and away from the dielectric belt 43. Herein, as illustrated in FIG. 6B, moving the second bottom plate 252 toward the dielectric belt 43 refers to rotating the second bottom plate 252 upward such that the minimum required area necessary to achieve attraction, which corresponds to the upper surface of the leading end of the sheet stack S loaded on the second bottom plate 252, comes into contact with the lower surface of the dielectric belt 43. Meanwhile, as illustrated in FIG. 6C, moving the second bottom plate 252 away from the dielectric belt 43 refers to rotating the second bottom plate 252 downward such that the upper surface of the sheet stack S is separated from the dielectric belt 43 having the uppermost sheet S1 attracted thereto.

Figure 6A:
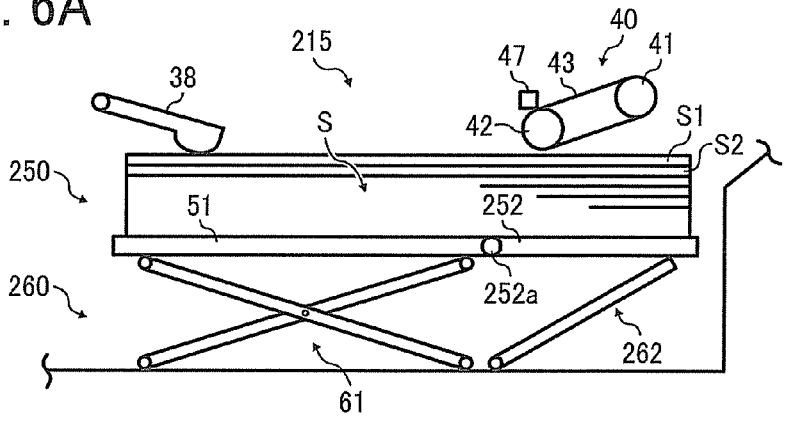
FIGS. 6A to 6C are diagrams illustrating an operation of the sheet feeder according to the second embodiment of the present invention.
Figure 6B:
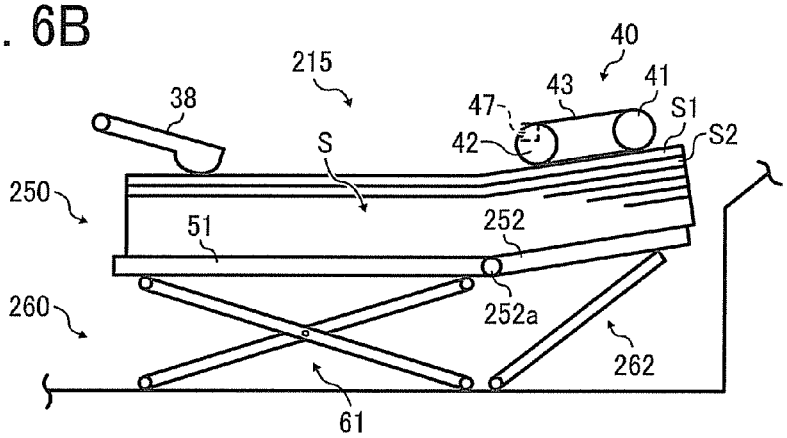
Figure 6C:
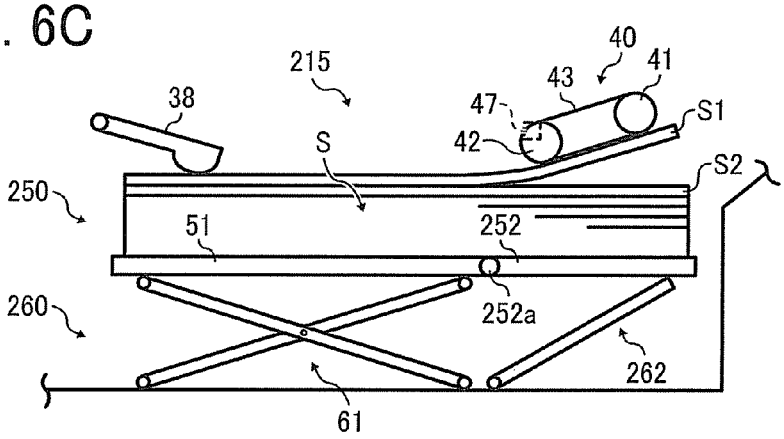

With reference to FIGS. 6A to 6C, the operation of the sheet feeder 215 will now be described. As illustrated in FIG. 6A, upon receipt of a sheet feeding command signal from the not-illustrated main control unit, the sheet feeder 215 first drives the drive roller 41 to rotate, and thereby the dielectric belt 43 is driven to rotate. Further, the dielectric belt 43 is applied with an alternating voltage via the charging roller 45 from the AC power supply 46. Thereby, charge patterns are formed on the outer circumferential surface of the dielectric belt 43. In this state, the first bottom plate 51 and the second bottom plate 252 are stopped at the sheet feedable position.

As illustrated in FIG. 6B, after the charging of the dielectric belt 43 is completed, the second lifting unit 262 rotates in the counterclockwise direction in the drawing, to thereby push upward a leading end portion in the sheet feeding direction of the second bottom plate 252. That is, the second lifting unit 262 lifts the second bottom plate 252 relative to the first bottom plate 51. Then, the second lifting unit 262 stops rotating, i.e., lifting the second bottom plate 252, when the upper surface of the leading end of the sheet stack S comes into contact with the outer circumferential surface of the dielectric belt 43 located under the drive roller 41. That is, the rotation, i.e., lifting of the second bottom plate 252 is stopped, when the roller position detecting sensor 47 detects the tilt of the dielectric belt 43 at a predetermined tilt angle. Therefore, unlike the first embodiment, the present embodiment has the roller position detecting sensor 47 set at a position allowing the roller position detecting sensor 47 to detect the tilt of the dielectric belt 43 at the predetermined tilt angle. Further, in this state, the leading end of the sheet stack S is tilted at a predetermined angle, and the upper surface of the tilted uppermost sheet S1 comes into contact with the lower surface of the dielectric belt 43. Then, the Maxwell stress acts on the uppermost sheet S1, which is a dielectric material, owing to a non-uniform electric field generated by the charge patterns formed on the outer layer of the dielectric belt 43. Thereby, the uppermost sheet S1 is attracted to the dielectric belt 43.

Then, after standing by at the position illustrated in FIG. 6B for a predetermined time taken for the attracting operation, the second lifting unit 262 lowers the second bottom plate 252 to the sheet feedable position, as illustrated in FIG. 6C. Thereby, the leading end of the uppermost sheet S1 is separated from the sheet stack S, and is attracted to and held by the dielectric belt 43.

Then, as in the first embodiment, the dielectric belt 43 is driven to rotate, and the uppermost sheet S1 attracted to and held by the dielectric belt 43 is accordingly separated from the dielectric belt 43 at the drive roller 41 owing to the curvature thereof, conveyed in the sheet feeding direction, and sent to the conveyance path 10*a* illustrated in FIG. 1. The uppermost sheet S1 sent to the conveyance path 10*a* is conveyed to the image forming unit 14 by the conveying roller pair 18 and the registration roller pair 19, as illustrated in FIG. 1. The operation subsequent to the separation of the uppermost sheet S1 is similar to that of the first embodiment, and thus detailed description thereof will be omitted.

The operation performed in the continuous sheet feeding operation is also similar to that of the first embodiment. In the present embodiment, however, it is desirable to set the tilt angle of the second bottom plate 252 to a relatively large value to reliably bring the sheet stack S into contact with the dielectric belt 43. To maintain a certain degree of tilt angle, therefore, the present embodiment lifts the first bottom plate 51 and the second bottom plate 252 in synchrony with each other more frequently than in the first embodiment. Even if the tilt angle is increased, the dielectric belt 43 rotates to follow the change in angle of the sheet stack S owing to the self-weight of the driven roller 42. Accordingly, the upper surface of the uppermost sheet S1 and the lower surface of the dielectric belt 43 are reliably brought into contact with each other.

As described above, in the present embodiment, the second bottom plate 252 is rotated about the hinge 252*a* to lift and lower the second bottom plate 252. Therefore, only the leading end of the sheet stack S is lifted in the lifting operation of the second bottom plate 252. Accordingly, the present embodiment is capable of lifting only a portion of the sheet stack S required for the attracting and separating operation with lower drive force than in the configuration which lifts the entire sheet stack S or the configuration of the first embodiment which lifts only the leading end of the sheet stack S parallel to the first bottom plate 51 and keeps the entire leading end essentially horizontal.

Accordingly, the present embodiment reduces the load on the lifting mechanism unit 260 and the time taken for, for example, the attracting and separating operation. Even the configuration of moving the dielectric belt 43 and the sheet stack S toward and away from each other, therefore, obtains relatively high productivity.

A sheet feeder according to a third embodiment of the present invention will now be described, with reference to FIG. 7.

The sheet feeder according to the third embodiment is different from the sheet feeder according to the first embodiment of the present invention in the configuration of the sheet loading unit and the lifting mechanism unit, but is otherwise substantially similar in the other configurations to the sheet feeder according to the first embodiment. Therefore, the following description, using the reference numerals of the first embodiment illustrated in FIGS. 1 to 4B, concentrates on only the differences between the third embodiment and the first embodiment.

Figure 7:
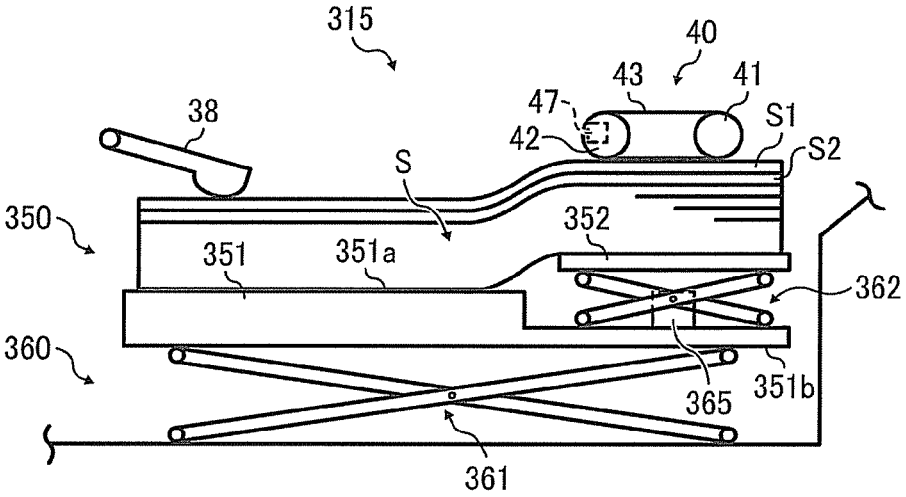
FIG. 7 is a cross-sectional view illustrating a schematic configuration of a sheet feeder according to a third embodiment of the present invention.

As illustrated in FIG. 7, a sheet feeder 315 according to the present embodiment includes an attracting and separating unit 40, a sheet loading unit 350, and a lifting mechanism unit 360. The attracting and separating unit 40 serving as an attracting and separating device is similar in configuration to the attracting and separating unit 40 of the first embodiment, and thus description thereof will be omitted. The sheet loading unit 350 serves as a sheet loading device which carries the sheet stack S loaded thereon. The lifting mechanism unit 360 serves as a lifting device which lifts and lowers the sheet loading unit 350.

The sheet loading unit 350 includes a first bottom plate 351 and a second bottom plate 352. The first bottom plate 351 carries the trailing end portion of the sheet stack S loaded thereon. The second bottom plate 352 is provided separately from and disposed on the first bottom plate 351, and carries the leading end portion of the sheet stack S loaded thereon below the attracting and separating unit 40. In the present embodiment, the first bottom plate 351 includes a sheet loading portion 351*a* and a bottom plate storing portion 351*b*. The sheet loading portion 351*a* carries the sheet stack S loaded thereon. The bottom plate storing portion 351*b* is recessed in the thickness direction relative to the sheet loading portion 351*a*, and carries the second bottom plate 352 and a second lifting unit 362 disposed thereon.

The lifting mechanism unit 360 includes the second lifting unit 362 and a first lifting unit 361. The first lifting unit 361 serves as a first lifting device which lifts and lowers the first bottom plate 351. The second lifting unit 362 serves as a second lifting device which lifts and lowers the second bottom plate 352. The first bottom plate 351, the second bottom plate 352, the first lifting unit 361, and the second lifting unit 362 are disposed in a not-illustrated sheet feeding cassette having a substantially flat box shape.

The first lifting unit 361 is formed by a linkage mechanism similar in configuration to the linkage mechanism of the first embodiment. The second lifting unit 362 is similar in configuration to the second lifting unit 62 of the first embodiment. However, the location of the second lifting unit 362 is different from the location of second lifting unit 62 of the first embodiment. The second lifting unit 362 is disposed on the above-described bottom plate storing portion 351*b* of the first bottom plate 351. Further, a motor 365 for driving the second lifting unit 362 is provided on the bottom plate storing portion 351*b*. The second lifting unit 362 is driven by the motor 365 to ascend and descend on the first bottom plate 351. The motor 365 of the present embodiment forms a drive device according to an embodiment of the present invention.

The present embodiment is different from the first embodiment in that there is no need to lift the first bottom plate 351 and the second bottom plate 352 in synchrony with each other in the operation of lifting the sheet stack S to the sheet feedable position. The present embodiment, however, is similar to the first embodiment in the other operations.

As described above, in the present embodiment, the first lifting unit 361 lifts and lowers the entire sheet stack S, and the second lifting unit 362 lifts the second bottom plate 352 only by the distance required for the attracting and separating operation of the uppermost sheet S1. Therefore, the drive amount and the movable range of the second lifting unit 362 are reduced. Accordingly, the second lifting unit 362 has a relatively simple and compact configuration.

Further, the drive control of the respective lifting devices, i.e., the first lifting unit 361 and the second lifting unit 362 is simplified in the present embodiment as compared with, for example, the first embodiment having the first bottom plate 51 and the second bottom plate 52 provided separately from each other. That is, in the first embodiment having the first bottom plate 51 and the second bottom plate 52 provided separately from each other, the respective lifting devices, i.e., the first lifting unit 61 and the second lifting unit 62 vertically move the first bottom plate 51 and the second bottom plate 52, respectively, in synchrony with each other in the operation of lifting and lowering the entire sheet stack S. Therefore, the drive control therefor is relatively complicated. Meanwhile, in the present embodiment, there is no need to drive the first bottom plate 351 and the second bottom plate 352 in synchrony with each other, and thus the drive control therefor is simplified.

Further, in the present embodiment, the motor 365 for driving the second lifting unit 362 is provided on the bottom plate storing portion 351*b* of the first bottom plate 351. Therefore, a drive transmission mechanism between the motor 365 and the second lifting unit 362 has a relatively simple configuration. That is, the motor 365 vertically moves in accordance with the upward and downward movement of the first bottom plate 351, and thus the positional relationship between the motor 365 and the second lifting unit 362 is unchanged, irrespective of the upward and downward movement of the first bottom plate 351. Accordingly, the second lifting unit 362 is driven without a relatively complicated configuration of switching between drive transmission paths in accordance with the upward and downward movement of the first bottom plate 351.

Figure 8:
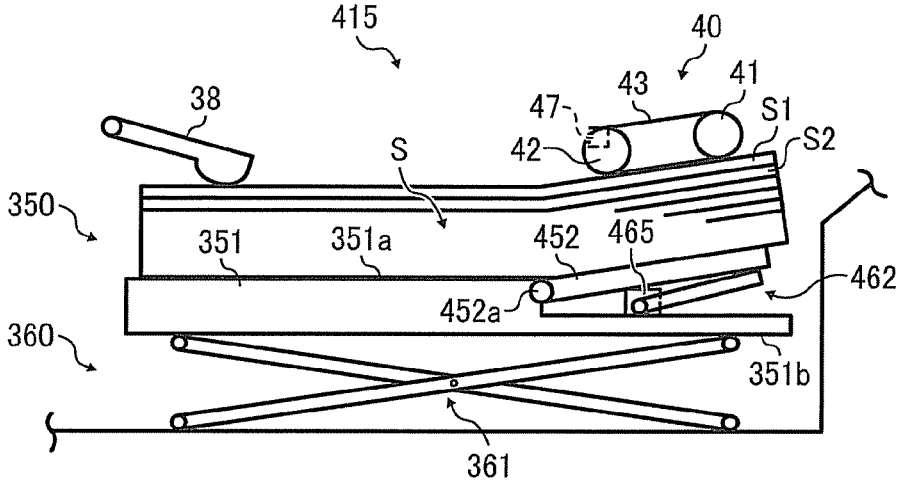
FIG. 8 is a cross-sectional view illustrating a modified example of the sheet feeder according to the third embodiment of the present invention.

In the present embodiment, the second bottom plate 352 is lifted and lowered in a parallel, i.e., horizontal manner to the first bottom plate 351, as in the first embodiment. The configuration, however, is not limited thereto. For example, as illustrated in FIG. 8, a sheet feeder 415 may be employed which is configured to rotate a second bottom plate 452 about a hinge 452*a* relative to the first bottom plate 351, as in the second embodiment. In this case, a second lifting unit 462 serving as a second lifting device and including a single arm for rotating the second bottom plate 452 is disposed on the bottom plate storing portion 351*b* of the first bottom plate 351. Further, a motor 465 for driving the second lifting unit 462 is provided on the bottom plate storing portion 351*b*. The second lifting unit 462 is driven by the motor 465 to ascend and descend on the first bottom plate 351. The motor 465 of the present embodiment forms a drive device according to an embodiment of the present invention.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. A sheet feeder, comprising:

an attracting and separating device disposed above a leading end portion of a sheet stack, and configured to attract and hold from the sheet stack an uppermost sheet on the uppermost position of the sheet stack using electrostatic force and separate the uppermost sheet from the sheet stack;

a sheet loading device disposed below the attracting and separating device to carry the sheet stack loaded thereon, and including a first bottom plate configured to carry a trailing end portion of the sheet stack loaded thereon and a second bottom plate contiguous to and provided separately from the first bottom plate and configured to carry the leading end portion of the sheet stack loaded thereon; and a lifting device to lift and lower the sheet loading device, and including a first lifting device configured to lift and lower the first bottom plate and a second lifting device configured to lift and lower the second bottom plate to move the leading end portion of the sheet stack toward and away from the attracting and separating device, wherein the second bottom plate and the second lifting device are disposed on an upper surface of the first bottom plate at a position corresponding to the leading end portion of the sheet stack.

2. The sheet feeder according to claim 1, further comprising an angle detector provided adjacent to a lateral portion of the attracting and separating device, wherein the attracting and separating device includes a downstream roller provided on the downstream side in the sheet feeding direction, an upstream roller provided upstream of the downstream roller in the sheet feeding direction and rotatable about the downstream roller as a hinge, and an endless dielectric belt rotatably stretched around the upstream roller and the downstream roller, wherein the detector detects the arrival of the dielectric belt to a position parallel to the sheet stack.

3. The sheet feeder according to claim 2, wherein the detector is one of a photointerrupter and a feeler sensor.

4. The sheet feeder according to claim 1, wherein the second lifting device lifts and lowers the second bottom plate parallel to the first bottom plate.

5. The sheet feeder according to claim 1, wherein the first bottom plate and the second bottom plate are joined by a hinge, the second bottom plate being rotatable about the hinge relative to the first bottom plate, and wherein the second lifting device rotates the second bottom plate about the hinge to lift and lower the second bottom plate.

6. The sheet feeder according to claim 1, further comprising:

a drive device provided to the first bottom plate to drive the second lifting device.

7. An image forming apparatus comprising:

a sheet feeder according to claim 1; and an image forming device to form an image on an uppermost sheet separated and fed from the sheet stack by the sheet feeder.

8. The sheet feeder according to claim 1, wherein the first bottom plate includes a sheet loading portion and a bottom plate storing portion.

9. The sheet feeder according to claim 8, wherein the sheet loading portion carries the sheet stack loaded thereon.

10. The sheet feeder according to claim 8, wherein the bottom plate storing portion is recessed in a thickness direction relative to the sheet loading portion, and carries the second bottom plate and the second lifting plate disposed thereon.

11. The sheet feeder according to claim 8, wherein the second lifting device is disposed on the bottom plate storing portion of the first bottom plate.

12. The sheet feeder according to claim 8, further comprising a motor for driving the second lifting device provided on the bottom plate storing portion.

13. The sheet feeder according to claim 12, wherein the second lifting device is driven by the motor to ascend and descend on the first bottom plate.

* * * * *

UNITED STATES PATENT AND TRADEMARK OFFICE

CERTIFICATE OF CORRECTION

PATENT NO. : 8,480,073 B1
APPLICATION NO. : 13/333555
DATED : July 9, 2013
INVENTOR(S) : Yoshikuni Ishikawa et al.

It is certified that error appears in the above-identified patent and that said Letters Patent is hereby corrected as shown below:

Title Page:

Insert

Item --(65) Prior Publication Data

US 2013/0161894 A1 June 27, 2013--

Signed and Sealed this
Twenty-sixth Day of November, 2013

Margaret A. Focarino

Margaret A. Focarino
*Commissioner for Patents of the United States Patent and Trademark Office*